US005178313A

United States Patent [19]

LeCompte et al.

[11] Patent Number: 5,178,313

[45] Date of Patent: * Jan. 12, 1993

[54] PNEUMATIC SHOE FOR HIGH SPEED FILAMENTARY CAPSTAN

[75] Inventors: George LeCompte; Rudolph A. Eisentraut; Moran Coxon, all of Tucson, Ariz.

[73] Assignee: Hughes Aircraft Company, Los Angeles, Calif.

[ * ] Notice: The portion of the term of this patent subsequent to Aug. 13, 2008 has been disclaimed.

[21] Appl. No.: 706,453

[22] Filed: May 28, 1991

Related U.S. Application Data

[63] Continuation of Ser. No. 566,787, Aug. 13, 1990, Pat. No. 5,038,990, which is a continuation of Ser. No. 268,421, Nov. 8, 1988, abandoned.

[51] Int. Cl.[5] ..... B65H 51/04

[52] U.S. Cl. ..... 226/95; 226/93; 226/190

[58] Field of Search ..... 226/1, 7, 93, 95, 97, 226/168, 190, 200; 254/333, 134.4, 93 R

[56] References Cited

U.S. PATENT DOCUMENTS

| | | | |
|---|---|---|---|
| 2,871,502 | 2/1959 | Whisnant | 226/95 X |
| 3,143,267 | 8/1964 | Maxeg | 226/95 |
| 3,270,932 | 9/1966 | Smith, Jr. | 226/95 |
| 3,319,293 | 5/1967 | Gollos | 226/190 X |
| 3,332,597 | 7/1967 | Missioux | 226/190 |
| 3,926,353 | 12/1975 | Gay | 226/95 |
| 3,999,970 | 12/1976 | Barch et al. | 277/DIG. 7 |
| 4,328,626 | 5/1982 | Leitnor | 226/95 X |
| 5,038,990 | 8/1991 | LeCompte | 226/1 |

FOREIGN PATENT DOCUMENTS 0495477 3/1928 Fed. Rep. of Germany ..... 226/190

*Primary Examiner*—Daniel P. Stodola
*Assistant Examiner*—Paul T. Bowen
*Attorney, Agent, or Firm*—R. M. Heald; C. D. Brown; W. K. Denson-Low

[57] ABSTRACT

An apparatus for uniformly applying a compressive force against a filament to pneumatically drive the filament or fiber optic cable against a capstan without any concentrated amount of stress at any point on the filament is effectuated by pneumatically forcing the filament into an equatorial V-groove defined in the capstan. Pneumatic pressure is applied to a predefined segment of the capstan by a pneumatic shoe having an internal shoe pressure chamber. The pressurized gas or air is applied to the segment from the chamber within the shoe into the proximity of the equatorial V-groove on the equator of a disc shaped capstan. The V-groove is vented to atmosphere so that the cable is forced or blown into the V-groove. Side and end clearances between the rotating capstan and the shoe are sized to allow the viscosity of the pressurized gas to operate to retard the escape of the pressurized gas from the predefined segment of the capstan. Annular interleaved baffles may also be provided on the equatorial surface of the capstan and the opposing surface of the shoe to provide additional frictional engagement between the pressurized gas and the elements in the proximity of the predetermined segment of the capstan. Utilizing such an arrangement, approximately 10 kilometers or more of filament can be paid out in approximately 32 seconds or less.

4 Claims, 2 Drawing Sheets

PNEUMATIC SHOE FOR HIGH SPEED FILAMENTARY CAPSTAN

This is a continuation of application Ser. No. 07/566,787 filed Aug. 13, 1990, now U.S. Pat. No. 5,038,990, which is itself a continuation of application Ser. No. 07/268,421 filed Nov. 8, 1988 and now abandoned.

BACKGROUND OF THE INVENTION

1. Field of the Invention

The invention relates to the field of machines for handling filamentary or fiber optic cables and in particular to a pneumatic shoe and capstan design for paying out filament at high speed. The terms filament and fiber optic cable as used herein have the same meaning and include very small filaments such as optical fibers.

2. Description of the Prior Art

In the course of optically testing filamentary or fiber optic cable for various types of applications it is necessary to pay out the cable at a very high speed in a laboratory or test enviroment. The problem is to apply a sufficient force to a fiber optic cable to pull it from a supply reel or other supply source and to move it at a high rate of speed to or through a test station. The force must be applied to the filament in such a manner that damage or distortion to the cable is avoided and without applying any permanent strains to the cable, abrading or otherwise blemishing the optical surface of the fiber optic cable, or otherwise affecting its optical properties.

Therefore, what is needed is a methodology and apparatus whereby a force may be gently and uniformly applied to filament with a sufficiently high magnitude that enough tensile force can be applied to the filament to pull it at a high rate of speed without damaging, nicking, kinking, abrading or otherwise applying a distorting or degrading force to the filament.

BRIEF SUMMARY OF THE INVENTION

The invention is an apparatus for pulling a filamentary or fiber optic cable at a high rate of speed comprising a source of pressurized gas, a capstan and a shoe. The capstan frictionally engages the filament along a predetermined segment of the capstan. The shoe is disposed over at least the segment of the capstan, which segment is in frictional engagement with the filament. The shoe has defined therein a shoe pressure chamber. The shoe pressure chamber is pneumatically communicated with the source of pressurized gas so that the pressurized gas is supplied through the shoe into the proximity of the segment of the capstan in frictional engagement with the filament. An arrangement is defined for forcing the filament into frictional contact with at least a segment of the capstan by flow of the pressurized gas through the shoe into the proximity of the segment of the capstan.

As a result, a uniform stress is applied to the filament thereby allowing frictional engagement between the cable and the capstan and permitting rapid payout of the cable by rotation of the capstan.

The arrangement for forcing the filament into frictional engagement with the capstan comprises a vent defined into the capstan. The filament is forced by the pressurized gas into the vent.

The capstan is disc shaped and has an equatorial surface on its perimeter. The vent comprises a V-shaped groove in the circumference of the disc shaped capstan.

The capstan is comprised of a first disc portion, a second disc portion and a separator serving to space the first and second disc portions apart. The circumference radially extends to a predetermined distance radially inset from the equatorial plane of the disc. The V-groove is defined by the separation between the first and second portions of the capstan as produced by the spacer between the first and second portions of the capstan.

The arrangement for forcing the filament into frictional engagement with the capstan also comprises an arrangement for increasing the friction of the pressurized gas with the capstan.

The arrangement for increasing friction further comprises arrangement for increasing friction of the pressurized gas with the shoe.

The arrangement for increasing friction of the pressurized gas with the capstan comprises a plurality of annular radially extending baffles defined in the equatorial surface of the capstan.

The arrangement for increasing friction with the shoe also comprises a plurality of radially extending annular circular baffles projecting from the shoe toward the equatorial surface of the capstan.

The plurality of radially extending baffles from the shoe and from the capstan are interleaved.

The apparatus further comprises a pressure reducing valve. The pressurized gas applied from the source to the shoe pressure chamber within the shoe is throttled by a pressure reducing valve.

The source of pressurized gas provides dry pressurized air.

The invention is also a method for applying tension to a filament to pay out the filament at a high rate of speed comprising the steps of frictionally engaging the filament with a segment of a rotating capstan by pneumatically forcing the filament against an equatorial vent line defined in the capstan. The escape of the pressurized gas around the proximity of the segment of the capstan frictionally engaging the filament is retarded in order to maintain the gas pressure against the cable during a predetermined payout period. The predetermined exit pressure magnitude of the pressurized gas in the proximity of the segment of the capstan frictionally engaging the filament is maintained during the payout period.

As a result, a tensile force is applied to the filament in order to pull the cable from a source of supply without applying concentrated stresses to the filament at any point.

In the step of frictionally engaging the filament by pneumatically forcing the filament into a vent line, the filament is pneumatically forced into a V-groove defining an orifice to the vent line. The V-groove is annularly defined on the equatorial surface of the capstan.

In the step of maintaining the slot exit pressure, the pressurized gas is supplied to a proximity of the segment of the capstan frictionally engaging the filament from a compressed gas tank having a volume to provide sufficient mass flow for the predetermined payout period through a throttle to provide a constant stagnation pressure.

In the step of retarding escape of pressurized gas, the escape is retarded by providing a labyrinthian duct through which the pressurized gas must flow to reach ambient pressure.

The invention can still further be characterized as an apparatus for paying out filament at a high rate of speed without application of any concentrated stress at any point comprising a shoe for receiving pressurized gas. A shoe pressure chamber is defined within the shoe for distributing the pressurized gas through the shoe to an arcuous azimuthal segment. A capstan is disposed at least in part in the arcuous segment provided by the shoe. The capstan defines an equatorial vent line for providing an escape slot through the capstan for the pressurized gas. The filament is forced by the pressurized gas suppliable through the shoe into the equatorial vent slot.

As a result, a uniform normal force is applied to the filament forcing the filament against the capstan without concentration of stress at any point.

The shoe radially overlaps the capstan in the segment for a predefined distance. The radial overlap defines a side slot. Azimuthal overlap of the capstan and shoe defines end slots. The end slots and side slots are sized to permit viscosity of the pressurized gas flowing through the end slots and side slots to retard escape of the pressurized gas from the arcuous segment.

The apparatus further comprises an arrangement for enhancing frictional engagement between the pressurized gas and the shoe and capstan to retard escape of the gas pressure from the arcuous segment.

The invention and its various embodiments may be better understood by now turning to the following drawings where like elements are referenced by like numerals.

The invention and its various embodiments may be better understood by now turning to the following detailed description.

DETAILED DESCRIPTION OF THE PREFERRED EMBODIMENTS

An apparatus and methodology for uniformly applying a compressive force against a filament or fiber optic cable to pneumatically drive the filament against a capstan without any concentrated amount of stress at any point on the filament is effectuated by pneumatically forcing the filament into an equatorial V-groove defined in the capstan. Pneumatic pressure is applied to a predefined segment of the capstan by a pneumatic shoe having an internal shoe pressure chamber. The pressurized gas or air is applied to the segment from the chamber within the shoe into the proximity of the equatorial V-groove on the equator of a disc shaped capstan. The V-groove is vented to atmosphere so that the cable is forced or blown into the V-groove. Side and end clearances between the rotating capstan and the shoe are sized to allow the viscosity of the pressurized gas to operate to retard the escape of the pressurized gas from the predefined segment of the capstan. Annular interleaved baffles may also be provided on the equatorial surface of the capstan and the opposing surface of the shoe to provide additional frictional engagement between the pressurized gas and the elements in the proximity of the predetermined segment of the capstan. Utilizing such an arrangement, approximately 10 kilometers or more of filament can be paid out in approximately 32 seconds or less.

Figure 1:
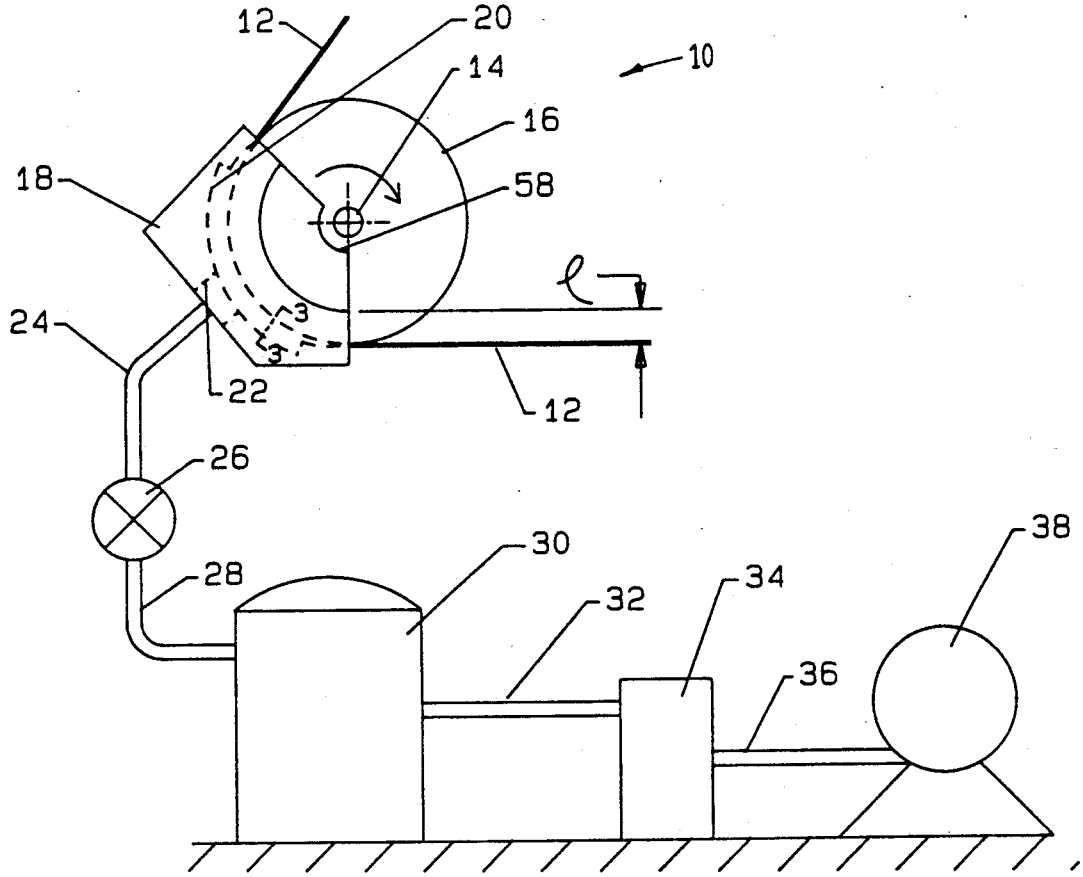
FIG. 1 is a diagrammatic side view of a pneumatic pinch shoe according to the invention for pulling a filament and a mechanism for operating the pinch shoe.

FIG. 1 is a highly diagrammatic side view of an apparatus in which a pneumatic pinch shoe, generally denoted by reference numeral 10, is depicted for driving or paying out a filament 12. The various elements of the apparatus in FIG. 1 are not to scale and where the detail is irrelevant to the primary thrust of the invention, various details of certain elements have been omitted. For example, it must be understood that capstan 16 is driven by means of an axle 14 which in turn is driven by a conventional motor, typically an air turbine motor, which is shown symbolically as motor 13. Electric motor 13 in turn is powered and controlled by various types of conventional electronic circuitry which are of no consequence to the invention. Pinch shoe 10 includes a thin disc V-groove capstan 16 which is driven by axle 14. A shoe 18 is disposed over an azimuthal segment of capstan 16 as shown in the side view of FIG. 1 and encloses capstan 16 to the extent of their mutual overlap as best depicted in the end elevational view of FIG. 2. Shoe 18 and capstan 16 are spaced apart and do not touch at any point. Shoe 18 includes an internal shoe pressure chamber 20 shown in dotted outline in FIG. 1. Pressure chamber 20 is communicated via a duct 22 through piping 24 to a pressure reduction valve 26. Pressure reduction valve 26 in turn is coupled via piping 28 to a pressurized air tank 30. Air tank 30 is coupled via a supply pipe 32 to a dryer 34 which removes water vapor and other contaminants from the air which is pressurized within tank 30. The pressurized air is delivered to dryer 34 through pipe 36 from a conventional air compressor 38. Removal of water vapor is required since the exit temperature of gas from pressure chamber 20 is low enough to cause freezing or condensation.

Figure 3:
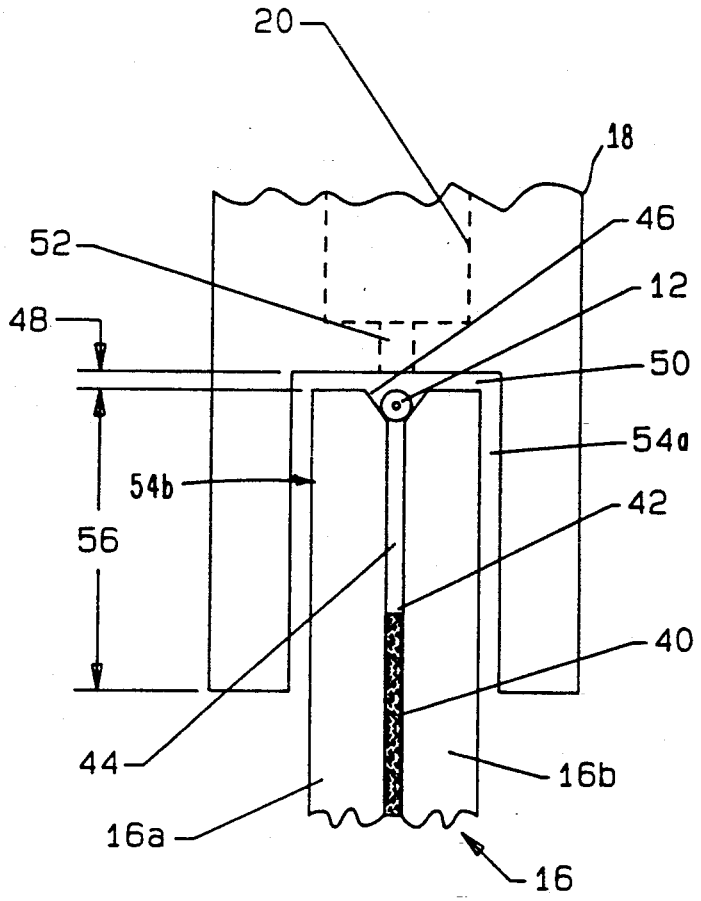
FIG. 3 is a diagrammatic fragmentary cross-sectional view in enlarged scale of the portion of the pinch shoe of FIGS. 1 and 2 as seen through section lines 3—3 of FIG. 1.

Turn now to FIG. 3 wherein the operation of pneumatic pinch wheel 10 in relationship to filament 12 can be better depicted and understood. FIG. 3 is a fragmentary cross-sectional view taken through lines 3—3 of FIG. 1 as seen in enlarged scale. FIG. 3 clearly illustrates that capstan 16 is fabricated from two symmetric halves split along an equatorial plane of circular disc-shaped capstan 16. Halves **16*a* and 16*b* of capstan 16 are bound together through an axially disposed disc-shaped spacer 40. Spacer 40, however, only extends radially to a predetermined point 42 between capstan halves 16*a* and 16*b*, thereby leaving an annular gap between halves 16*a* and 16*b* which extends from spacer 40 to the radial outermost perimeter of capstan 16. This gap serves as a vent 44 and clearly those portions of vent 44 outside of shoe 18 freely communicate with the atmosphere. The interior edge of each capstan half 16*a* and 16*b* is chamfered so as to form a dihedral V-groove 46 along the equator of capstan 16 when halves 16*a* and 16*b* are assembled together. V-groove 46 is the radial most extension or orifice of vent 44 and circumferentially extends about capstan 16**.

The function of apparatus 10 is to force filament 12 into V-groove 46 so that there will be sufficient frictional force developed between capstan 16 and cable 10 to exert the required pull on filament 12 to provide high speed payout of.

Filament 12 is pressed into V-groove 46 by means of pneumatic pressure. Pressurized dried air is applied through the compressor, dryer and tank system of FIG. 1 through pressure reducing valve 26 and ultimately to shoe pressure chamber 20 as shown in FIG. 3. A thin, uniform-width azimuthal end slot 48 marks the boundary between capstan 16 and shoe 18. End slot 48 forms a minimum or throat area into which is injected high pressure air from the interior of pneumatic shoe 18. High pressure air is communicated between shoe pressure chamber 20 and space 50 of shoe 18 by means of a plurality of ducts 52, one of which is shown diagrammatically in cross-sectional view in FIG. 3. End slot 48 is bounded by two side slots 54*a* and 54*b* which communicate with the ambient atmosphere.

It is believed, as a first approximation, that the air flow within space 50 is isentropic and that a sonic condition exists at end slot 48 and in side slots 54*a* and 54*b*. Given the conditions of stagnation pressure and temperature, the mass flow of air required for delivery to shoe 18 can then be estimated.

Air is supplied to pneumatic shoe 18 from high pressure tank 30 through reduction valve 26 so that the stagnation pressure within pneumatic shoe 18 is maintained at a desired constant level. In the illustrated embodiment the stagnation pressure is 150 psia. The required run time is estimated from the length of filament 12 which must be payed out and the payout speed. The size of tank 30 is then derived from considering the mass of air which needs to be supplied from tank 30 at the estimated rate.

However, these estimations merely set an upper bound because in practice the effects of the viscosity of the flow of air will be significant. In order to obtain a more realistic assessment, the flow of air in slots 48 and 54*a* and 54*b* must be considered. In the present analysis, slot flow has been treated as a Fanno flow, i.e. characterized by constant cross-sectional area in adiabatic flow with friction. The effect of rotation of capstan 16 due to viscous loading is very small and is generally neglected. The reduction of mass flow through slot 48 due to viscosity turns out to be significant in terms of reducing the necessary tank volume for a given run time.

Figure 2:
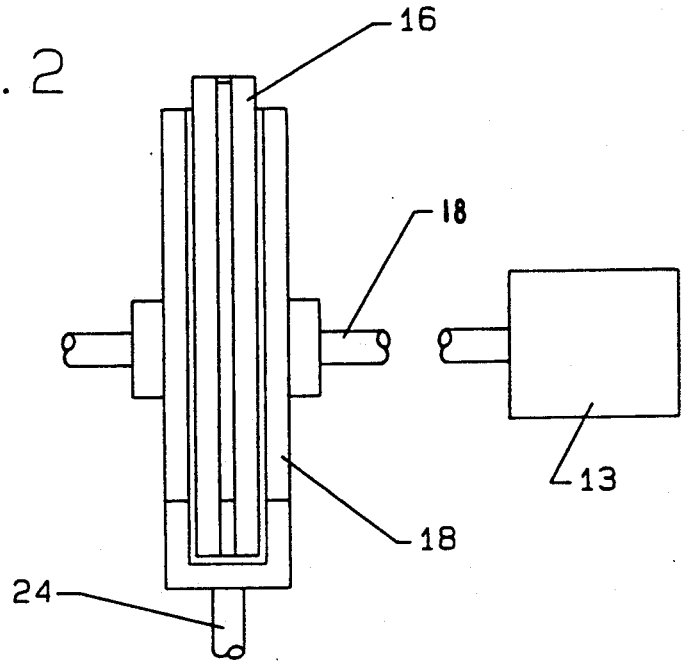
FIG. 2 is an end elevational view of the pinch shoe of FIG. 1.

Consider now the specific embodiment shown in FIGS. 1–3. In the illustrated embodiment capstan 16 has a radius of 6 inches and a full width of 0.5 inch. Each side slot gap width 54*a* and 54*b* between the sides of capstan 16 and the adjacent sides of shoe 18, is 0.002 inch. The distance of shoe and capstan overlap 56 is 1 inch. Finally, the sectorial angle 58 of shoe 18 adjacent to capstan 16 is ⅝ pi radians. Given a desired cable speed of 1,000 feet per second and a cable length of 32,808 feet (10 kilometers) with a capstan rotational speed of 19,099 rpm, an initial tank pressure of 200 psia and a shoe system stagnation pressure of 150 psia at a temperature of 288 decrees Kelvin, it is determined, that under Fanno flow conditions, the mass flow rate is 0.003819 slug per second with an exit slot pressure of 49.83 psia requiring a tank volume of 18.1 cubic feet for a 32.8 second run time. This is substantially less than the volume of 29.23 cubic feet for the tank volume which is the computed estimate when the viscosity of the air is ignored.

The air stored in the tank expands in a polytropic process as mass flow occurs from tank 30 to pinch shoe pressure chamber 20. If the stagnation pressure in shoe 18 is maintained at a fixed value by using a suitable pressure reduction valve, then it can be shown that the reduction in stagnation temperature during the run is fairly small from the range of tank pressure normally considered. A choke system with constant stagnation conditions will provide a fixed mass flow rate. This allows some simplification in the estimations leading to the prediction of necessary tank size and pressures. Ultimately the approximation formula given below will provide an estimate of the required tank volume.

$$V = \frac{T\,m'C^{1/n}}{(p_1^{1/n} - p_0^{1/n})}$$

where

V equals tank volume required for tank 30;

T is the time required for the pressure drop between an initial pressure of $P_1$ in the tank to a final pressure of $P_0$;

m′ is the mass flow rate;

n is 1.2; and

C is $1.767 \times 10^6$.

The effect of viscosity on the flow is estimated by assuming a Fanno flow, that is, a constant area, adiabatic flow with friction in a pipe equivalent to the actual exit slot having a length L and a hydraulic diameter D which is equal to four times the total area of the exit slot divided by the wetted perimeter of the exit slot.

The use of a high pressure chamber 20 assures of a sonic flow condition in the slot. A friction factor, f, is arbitrarily assumed. The slot inlet mach number is determined using flow tables. The remaining flow quantities at the inlet are calculated and a mass flow is determined. Inlet conditions are then used to find the Reynolds value and to obtain a new value for friction factor f. If the computed magnitude for the friction factor, f, does not agree with the originally assumed value, the procedure is repeated in an iterative process until the assumed and calculated values match within the desired error percentage. The tank requirement and exit pressure, as stated above, are then derived from the final iteration.

Using the physical dimensions of pneumatic shoe 18 stated above, a total area of exit slot of 0.05589 square inch and a wetted perimeter area of 51.89 inches can be calculated. The hydraulic diameter is then 0.0043 inch leading to an isentropic mass flow rate of 0.006171 slug per second. The run time is given as 32.8 seconds corresponding to a payout of approximately 10 kilometers of filament at 1,000 feet per second. Without accounting for the effects of viscosity of the fluid, the exit plane pressure would be expected to be 79.2 psia and the required tank volume, for a 200 psia initial pressure, is expected to be 29.23 cubic feet. This corresponds to a cylindrical tank of 2.5 feet in diameter and 6 feet in length.

However, when viscosity is considered, assuming a friction factor for Fanno flow given by $f=103.2/Re$ or $f=0.01$, a mass flow rate of 0.03819 slug per second and an exit plane pressure of 49.83 psia results. Under these conditions a tank 2.5 feet in diameter by 6 feet in length would allow a run time of 52.8 seconds, far in excess of that required. Instead, for the run time under consideration, a tank volume of only 18.1 cubic feet is required, a tank which allows a 38% reduction in tank volume as compared with an isentropic flow which does not consider viscosity of the air.

Figure 4:
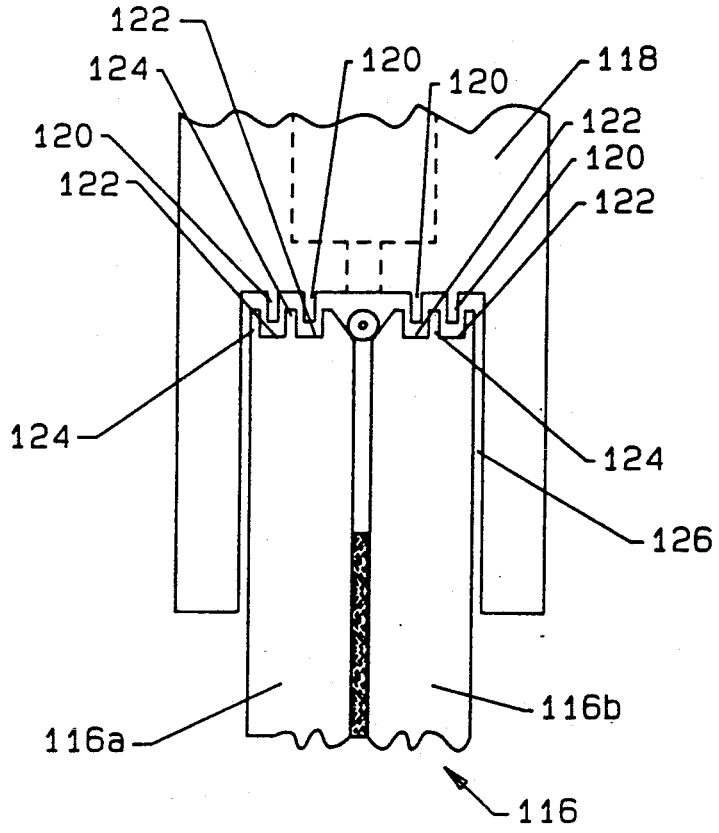
FIG. 4 is a diagrammatic fragmentary cross-sectional view of an alternative embodiment of the pinch shoe as would be seen through section lines 3—3 of FIG. 1 of a second embodiment of the invention.

Turn now to FIG. 4 which shows an alternative embodiment of the invention, wherein shoe 118 is similar to shoe 18 and capstan 116 similar to capstan 16 with the exception the the inner facing surfaces of each have been provided with annular, alternately positioned baffles to form a complex labyrinthian duct. More specifically, turning to FIG. 4, shoe 118 is provided with a plurality of annular radially extending baffles 120. Each baffle 120 extends into a corresponding indentation 122 defined in the radially outermost opposing surface of capstan 116. Indentations 120 can alternatively as defined by annular, radially extending baffles 124. The non-contacting intermeshing disposition of baffles 120 and 124 thereby define a serpentine air duct designed to enhance the effect of the viscosity of the air and to further reduce the amount of high pressure air required to complete a predetermined run of filament payout. By making the assumption that the "pipe length" of the entire duct is equal to the full path length of the labyrinth as seen in the view of FIG. 4 and assuming a Fanno flow of a system of two pipes in parallel which are fed from a common reservoir, namely shoe pressure chamber 20, a similar calculation, taking into account viscosity, as described above, can be made in connection with the embodiment of FIG. 4. The total mass flow for the system thus turns out to be 0.003292 slug per second and the resulting tank value for a run time of 32.8 seconds is 15.59 cubic feet, or a further reduction of 13.8% as compared to the embodiment of FIGS. 1-3.

Alternatively, the labyrinthian baffles may be deleted and elastomeric seals may be substituted.

Therefore, it can be seen that the use of a pneumatic shoe in conjunction with a V-groove capstan wheel as a means of deploying filament at very high speed under laboratory conditions can be practically achieved according to the invention. In all cases which have been considered, the pressures in the system remained well above the minimum required to prevent separation of the filament from the rim due to the action of centrifugal force on the cable. Furthermore, over a major portion of the cable length the full stagnation pressure is operative. The pressure applied by the pneumatic shoe capstan is very evenly applied without any pinch points or points of high concentration of stress so that a tensile force required to pull the cable quickly from a supply reel is achieved without any of the debilitating effects or damage encountered in the prior art.

Many modifications and alterations may be made by those having ordinary skill in the art without departing from the spirit and scope of the invention. Therefore, it is understood that the illustrated embodiment has been set forth only for the purposes of example and illustration and should not be taken as limiting the invention which is defined in the following claims.

We claim:

1. An apparatus for gripping and paying out optical filament at a high rate of speed without concentrating undue stress against the filament, comprising:

a capstan mounted for rotation about a longitudinal axis, said capstan having a grooved outer surface extending about its circumference, with the groove including a pair of spaced-apart sidewalls inclined relative to one another;

a shoe assembly positioned proximate to the grooved outer surface of the capstan and including pressure delivery means for directing gas pressurized above ambient pressure to a predefined area through which the grooved outer surface of the capstan rotates, thereby forcing an optical filament into temporary frictional contact with the groove sidewalls as the outer surface rotates through the predefined area; and a gap located within an interior portion of the capstan, said gap providing direct fluid communication between portions of the groove located both inside and outside the predefined area;

whereby said pressure delivery means provides and maintains above ambient pressure against a side of the optical filament facing the shoe assembly while the gap provides and maintains ambient pressure adjacent an opposite side of the optical filament to maintain the optical filament in frictional contact with the inclined sidewalls of the groove without generating undue stress against the optical filament during high speed payout.

2. An apparatus according to claim 1, wherein said rotating capstan includes a pair of substantially disc-shaped members with a disc-shaped spacer engaging and retaining the members in a spaced-apart, parallel extending relationship.

3. An apparatus according to claim 2, wherein said spacer forms an interior wall of said gap and said groove forms an outermost extension of said gap.

4. An apparatus according to claim 1, wherein said inclined sidewalls form a V-shaped groove.

* * * * *